US009140222B2

(12) United States Patent
Shimomura et al.

(10) Patent No.: US 9,140,222 B2
(45) Date of Patent: Sep. 22, 2015

(54) INTAKE PASSAGE STRUCTURE FOR VEHICLE

(71) Applicant: HONDA MOTOR CO., LTD., Tokyo (JP)

(72) Inventors: Nobuyuki Shimomura, Wako (JP); Tomoyuki Okamoto, Wako (JP); Yasushi Omika, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 58 days.

(21) Appl. No.: 14/076,906

(22) Filed: Nov. 11, 2013

(65) Prior Publication Data

US 2014/0174394 A1 Jun. 26, 2014

(30) Foreign Application Priority Data

Dec. 26, 2012 (JP) ..... 2012-282482

(51) Int. Cl.

| | |
|---|---|
| ***B62K 11/00*** | (2006.01) |
| ***F02M 35/16*** | (2006.01) |
| ***F02M 35/02*** | (2006.01) |
| ***F02M 35/024*** | (2006.01) |
| ***F02M 35/10*** | (2006.01) |

(52) U.S. Cl.

CPC ..... *F02M 35/162* (2013.01); *F02M 35/0202* (2013.01); *F02M 35/024* (2013.01); *F02M 35/10039* (2013.01)

(58) Field of Classification Search

CPC ..... F02M 35/10144; F02M 35/10; F02M 35/084; F02M 35/02416; F02M 35/024; F02M 35/162; F02M 35/0202; F02M 35/10039

USPC ..... 123/184.21–184.61

See application file for complete search history.

(56) References Cited

U.S. PATENT DOCUMENTS

| | | | | |
|---|---|---|---|---|
| 5,900,595 | A * | 5/1999 | Akima et al. | 181/229 |
| 2005/0045147 | A1* | 3/2005 | Ishikawa et al. | 123/336 |
| 2005/0066926 | A1* | 3/2005 | Ishikawa et al. | 123/184.34 |
| 2007/0193804 | A1* | 8/2007 | Yokoi | 180/219 |
| 2009/0126670 | A1* | 5/2009 | Kado et al. | 123/184.21 |
| 2009/0194054 | A1* | 8/2009 | Nagao et al. | 123/184.53 |
| 2010/0162997 | A1* | 7/2010 | Fukuuchi | 123/399 |
| 2011/0210183 | A1* | 9/2011 | Hanson et al. | 239/8 |
| 2011/0232982 | A1* | 9/2011 | Abe et al. | 180/68.3 |
| 2014/0041615 | A1* | 2/2014 | Koyama | 123/184.57 |

FOREIGN PATENT DOCUMENTS

JP 2008-248718 A 10/2008

* cited by examiner

*Primary Examiner* — Marguerite McMahon

(74) *Attorney, Agent, or Firm* — Westerman, Hattori, Daniels & Adrian, LLP

(57) ABSTRACT

The length of a connecting tube in an intake passage structure for a vehicle can be secured, and the number of components around the connecting tube can be reduced. Provided is an intake passage structure for a vehicle including a connecting tube and an engine, the connecting tube connecting an air cleaner box which purifies air and a throttle body and formed of two or more separate components, the engine being configured to be supplied with purified air. In the intake passage structure, a joint area at which the connecting tubes are connected in a predetermined positional relation is disposed inside the air cleaner box.

7 Claims, 9 Drawing Sheets

INTAKE PASSAGE STRUCTURE FOR VEHICLE

CROSS-REFERENCE TO RELATED APPLICATIONS

The present application claims priority under 35 U.S.C. §119 to Japanese Patent Application No. 2012-282482, filed Dec. 26, 2012, the contents of which is incorporated herein, by reference, in its entirety.

TECHNICAL FIELD

The present invention relates to an intake passage structure for a vehicle including a connecting tube connecting an air cleaner and a throttle body.

BACKGROUND OF THE INVENTION

Heretofore, an intake passage structure for a motorcycle has been known in which a connecting tube for air to pass through to a throttle body after being purified by an air cleaner is formed of three separate components outside the air cleaner (see Japanese Patent Application Publication No. 2008-248718, for example). Specifically, of the three components, the upstream and downstream tubes are made of rubber, and the middle tube connecting them to each other and having multiple bent portions is formed by blow molding. In this configuration, the connecting tube is provided in such a way as to bend at multiple spots within a small space. In this way, the length of the connecting tube can be increased, thereby making it possible to increase the low-speed torque of the engine.

SUMMARY OF THE INVENTION

However, in the case of the conventional intake passage structure described above, additional components such as bands are necessary for joint areas of each separate tube in order to secure a seal between the separate parts of the connecting tube, and increase in the number of components and cost has been a problem.

The length of a connecting tube in an intake passage structure for a vehicle can be secured and also the number of components around the connecting tube can be reduced.

An intake passage structure for a vehicle includes a connecting tube and an engine, the connecting tube connecting an air cleaner which purifies air and a throttle body and formed of two or more separate components, the engine being configured to be supplied with purified air, wherein a joint area at which the connecting tubes are connected in a predetermined positional relation is disposed inside the air cleaner.

The connecting tube connecting the air cleaner and the throttle body is formed of two or more separate components, and the joint area at which these connecting tubes are connected in a predetermined positional relation is disposed inside the air cleaner. Thus, airtightness of the air cleaner can be utilized, so that the joint area does not need to be firmly fixed with a band or the like. Accordingly, it is possible to secure the length of the connecting tube by forming the connecting tube with two or more separate components while reducing the number of components.

Moreover, the connecting tube includes an upstream connecting tube disposed inside the air cleaner and a downstream connecting tube penetrating the air cleaner, and the upstream connecting tube is disposed such that an extending direction thereof is along a longitudinal direction of a post-purification chamber of the air cleaner in a plan view, whereas the downstream connecting tube is disposed such that an extending direction thereof differs from the extending direction of the upstream connecting tube in the plan view.

It is possible to increase the length of the upstream connecting tube inside the air cleaner and also to lengthen the connecting tube in accordance with the layout of the engine and the throttle body.

Moreover, the upstream connecting tube and the downstream connecting tube are each in a bent form and provided such that a center axis of the bend of the upstream connecting tube differs from a center axis of the bend of the downstream connecting tube.

It is possible to lengthen the upstream connecting tube and the downstream connecting tube in accordance with the layout of the engine and the throttle body.

Furthermore, a middle connecting tube which connects the upstream connecting tube and the downstream connecting tube is provided between the upstream connecting tube and the downstream connecting tube.

The middle connecting tube makes it possible to connect the upstream connecting tube and the downstream connecting tube with a simple configuration.

Moreover, the middle connecting tube is inserted in and connected to the upstream connecting tube and the downstream connecting tube, and engagement portions for positioning in a circumferential direction are provided to peripheries of connected portions of the upstream connecting tube, the downstream connecting tube, and the middle connecting tube.

The engagement portions make it possible to position the connecting tube and prevent unnecessary movement of the connecting tube with a simple configuration.

Moreover, on the upstream connecting tube, an attaching portion is formed which extends in a direction perpendicular to the extending direction of the upstream connecting tube and is configured to be fixed to an inner side of an air cleaner case.

The attaching portion of the connecting tube makes it possible to fix the upstream connecting tube to the inner side of the air cleaner case with a simple configuration.

Furthermore, two or more of the attaching portions are provided to the upstream connecting tube, and a holding member is provided through which the upstream connecting tube is fixed to the air cleaner case side at the two or more attaching portions, and which has such a shape as to connect fixing spots on the attaching portions.

The upstream connecting tube can be fixed using the holding member which is relatively large and has an easy-to-handle shape. Accordingly, it is possible to firmly fix the upstream connecting tube and to achieve good workability.

In the intake passage structure for a vehicle, the airtightness of the air cleaner can be utilized, so that the joint area does not need to be firmly fixed with a band or the like. Accordingly, it is possible to secure the length of the connecting tube by forming the connecting tube with two or more separate components while reducing the number of components.

Moreover, it is possible to increase the length of the upstream connecting tube inside the air cleaner and also to lengthen the connecting tube in accordance with the layout of the engine and the throttle body.

Moreover, it is possible to lengthen the upstream connecting tube and the downstream connecting tube in accordance with the layout of the engine and the throttle body.

Furthermore, the middle connecting tube makes it possible to connect the upstream connecting tube and the downstream connecting tube with a simple configuration.

Moreover, the engagement portions make it possible to position the connecting tube and prevent unnecessary movement of the connecting tube with a simple configuration.

Moreover, the attaching portion of the connecting tube makes it possible to fix the upstream connecting tube to the inner side of the air cleaner case with a simple configuration.

Furthermore, the upstream connecting tube can be fixed using the holding member which is relatively large and has an easy-to-handle shape. Accordingly, it is possible to firmly fix the upstream connecting tube and to achieve good workability.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
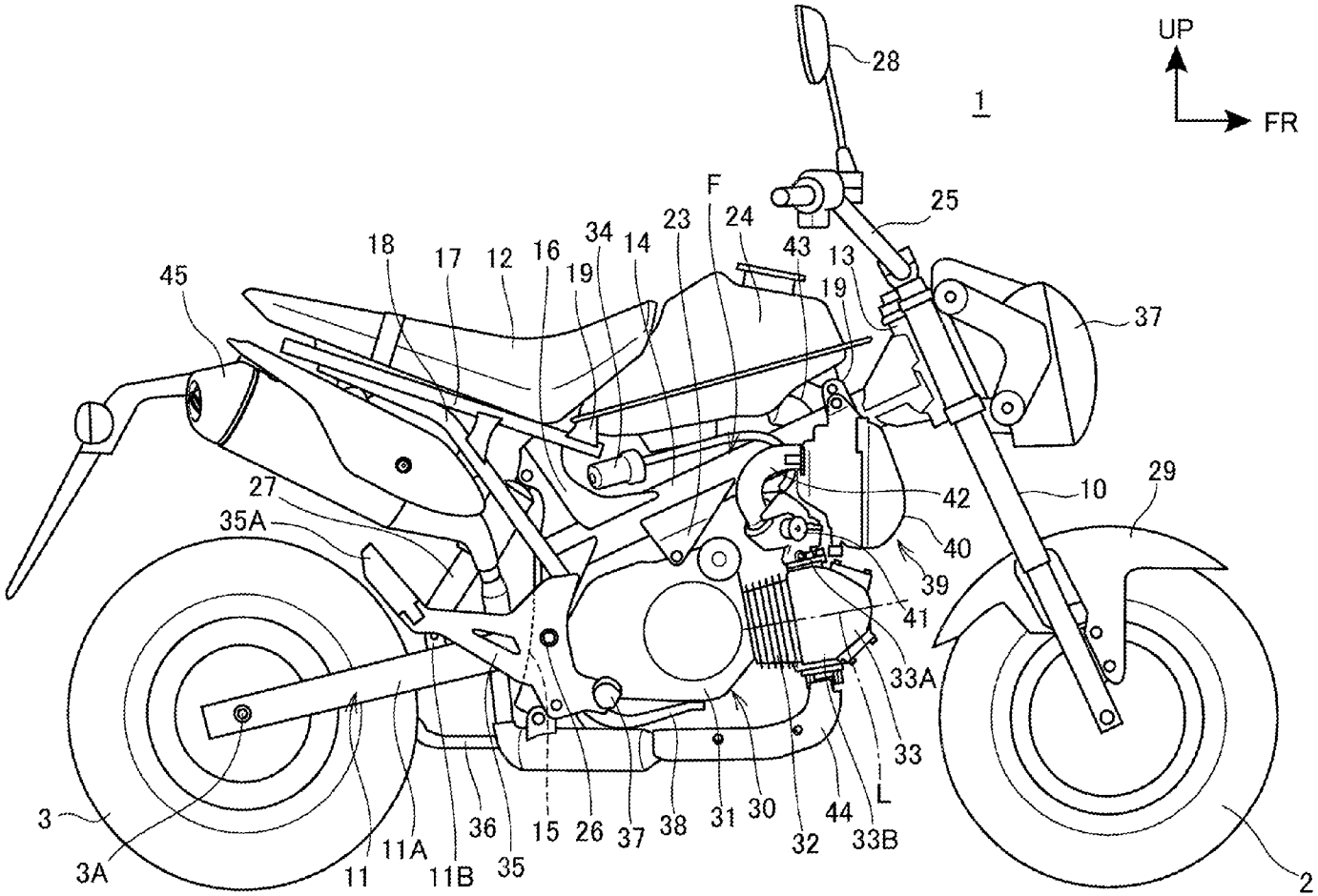
FIG. 1 is a right-side view of a motorcycle according to an embodiment.

Hereinbelow, an intake passage structure for a vehicle according to an embodiment of the present invention will be described with reference to the accompanying drawings. Note that directions such as front, rear, left, right, up, and down to be mentioned in the description should be considered to be identical to the directions based on the vehicle body unless otherwise noted. Moreover, reference numerals FR, UP, and LE shown in drawings denote the front side of the vehicle body, the upper side of the vehicle body, and the left side of the vehicle body, respectively.

FIG. 1 is a right-side view of a motorcycle according to an embodiment of the present invention.

As shown in FIG. 1, a motorcycle 1 (vehicle) is a saddle-ride type vehicle in which: an engine 30 is disposed at the center of a vehicle body frame F in the front-rear direction; front forks 10 that support a front wheel 2 are steerably supported on the front end of the vehicle body frame F; a swingarm 11 that supports a rear wheel 3 is provided to a rear part of the vehicle body frame F; and a seat 12 for an occupant to sit is provided above the vehicle body frame F.

The vehicle body frame F includes a head pipe 13, a single main frame 14, a pair of left and right center frames 15, a suspension bracket 16, a pair of left and right seat frames 17, and a pair of left and right sub frames 18. The head pipe 13 is provided at the front end. The main frame 14 extends rearward from the head pipe 13 while inclining obliquely downward. The center frames 15 extend outward in the vehicle width direction from the left and right surfaces of a rear portion of the main frame 14 and then extend downward. The suspension bracket 16 extends upwardly rearward from the upper surface of the rear portion of the main frame 14 toward the seat 12. The seat frames 17 extend upwardly rearward from an upper end portion of the suspension bracket 16 to a rear part of the vehicle. The sub frames 18 extend upwardly rearward behind the suspension bracket 16 from upper portions of the center frames 15, are joined to middle portions of the seat frames 17 in the front-rear direction, and then extend along the lower surfaces of the seat frames 17 to the rear ends of the seat frames 17.

An engine hanger 23 to fix the engine 30 is provided on the lower surface of a middle portion of the main frame 14 in the front-rear direction.

A fuel tank 24 is provided above the main frame 14 and stretches between the rear of the head pipe 13 and the front of each seat frame 17. The fuel tank 24 is fixed to tank stays 19 provided respectively on the upper surface of a front portion of the main frame 14 and the front ends of the seat frames 17. A fuel pump 34 that supplies fuel in the fuel tank 24 into the engine 30 is disposed between the lower surface of a rear portion of the fuel tank 24 and the main frame 14.

The seat 12 is provided in such a way as to be continuous with the rear portion of the fuel tank 24 and extends along the upper surfaces of the seat frames 17 to the rear part of the vehicle.

The pair of left and right front forks 10 are supported pivotally and turnably on the head pipe 13 through a steering shaft (not shown). The front wheel 2 is rotatably supported on lower portions of the front forks 10. A steering handlebar 25 is fixed to the upper ends of the front forks 10.

The swingarm 11 includes: a pair of left and right arm portions 11A (the left arm portion is not shown) extending rearward from the outer side surfaces of the center frames 15; and a cross member (not shown) connecting the left and right arm portions 11A at a front portion of the swingarm 11. The rear wheel 3 is rotatably supported on a rear portion of the swingarm 11 through an axle 3A laid between the arm portions 11A. The swingarm 11 is joined to the center frames 15 through a pivot shaft 26 inserted through the front ends of the arm portions 11A and is vertically swingable about the pivot shaft 26.

The lower end of a cylindrical rear cushion unit 27 is joined to a lower bracket 11B provided to the cross member of the swingarm 11, while the upper end of the rear cushion unit 27 is joined to the suspension bracket 16 of the vehicle body frame F.

The engine 30, for example, is an air-cooled single-cylinder four-stroke engine and is a horizontal engine inclined forward to a large extent such that its cylinder axis L is almost horizontal. The engine 30 is formed of a crankcase 31, a cylinder 32, and a cylinder head 33 in this order from the rear, the crankcase 31 incorporating a crankshaft (not shown) and a transmission (not shown). Since the engine 30 is a horizontal engine, the center of gravity of the vehicle body can be set low. An output shaft (not shown) of the engine 30 projects from the left surface of a rear portion of the crankcase 31. The rear wheel 3 is driven by a drive chain (not shown) laid between a drive gear (not shown) of the output shaft and a sprocket (not shown) of the rear wheel 3.

A pair of left and right steps 37 for the rider sitting on the seat 12 to place his or her feet (shoes) are provided on the left and right lower surfaces of the rear portion of the crankcase 31. A brake pedal 38 for braking operations of the rear wheel 3 is provided in front of the right step 37.

The engine 30 is supported on the vehicle body frame F by fixing a front upper portion of the crankcase 31 to the engine hanger 23 and also by fixing the rear portion of the crankcase 31 to the center frames 15.

In the motorcycle 1, the engine 30, which is a horizontal engine, is supported in such a way as to be hung on the main frame 14 which extends downwardly rearward, thereby securing a space between the front portion of the main frame 14 and the engine 30. In this space, an intake device 39 is disposed. The intake device 39 includes: an air cleaner box 40 which purifies sucked air; a throttle body 41 which supplies air from the air cleaner box 40 to the engine 30; and a connecting tube 42 which connects the air cleaner box 40 and the throttle body 41. The throttle body 41 is provided with an injector (not shown) which injects fuel supplied from the fuel tank 24 into an intake passage.

The air cleaner box 40 is formed in a large box shape stretching vertically inside the space between the lower surface of the front portion of the main frame 14 and the upper surface of the cylinder head 33 to such an extent as to vertically fill the space almost completely. An intake duct 43 to take air into the air cleaner box 40 extends upwardly rearward on a left side of the main frame 14 from a rear left portion of the air cleaner box 40 and is opened toward the rear below the fuel tank 24.

The throttle body 41 is disposed behind the air cleaner box 40 between the cylinder head 33 and the main frame 14 and is connected to an intake port 33A in the upper surface of the cylinder head 33.

An exhaust pipe 44 is connected to an exhaust port 33B in the lower surface of the cylinder head 33. The exhaust pipe 44 extends downward from the exhaust port 33B, bends and extends rearward, bends upward behind the center frames 15, and connects to a muffler 45 fixed to the right seat frame 17.

Plate-shaped step stays 35 are provided on the side surfaces of the center frames 15 in such a way as to cover the front end of the swingarm 11 from the lateral sides, respectively. Tandem steps 35A for a passenger to place his or her feet are provided at the rear ends of the step stays 35.

A side stand 36 is attached to the lower end of the left center frame 15.

A headlight unit 37 is attached to a front portion of the head pipe 13. Side mirrors 28 are provided on the handlebar 25.

A front fender 29 covering the front wheel 2 from above is attached to the front forks 10.

Figure 2:
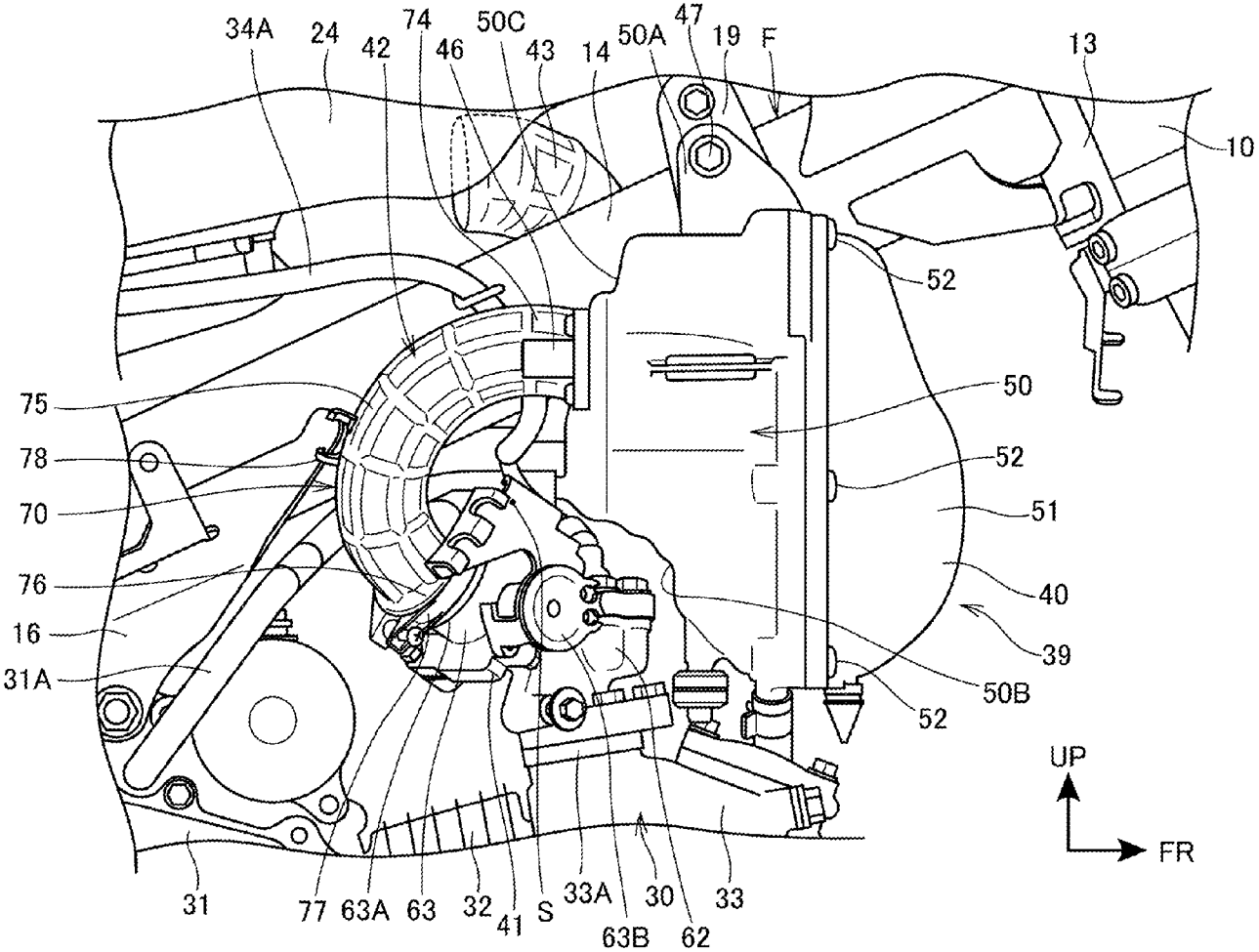
FIG. 2 is a right-side view showing an intake device and its vicinity.
Figure 3:
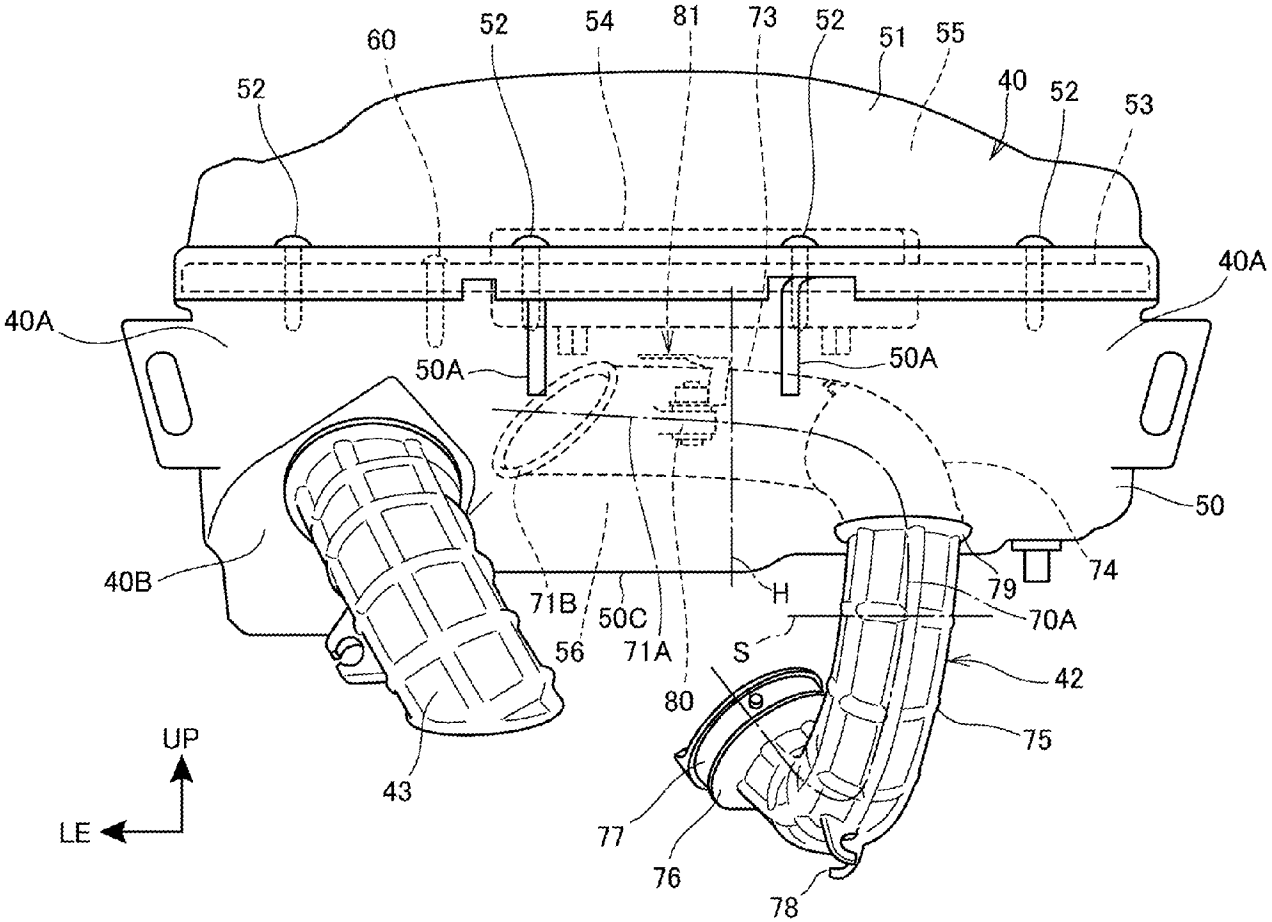
FIG. 3 is a plan view of an air cleaner box as seen from above.
Figure 4:
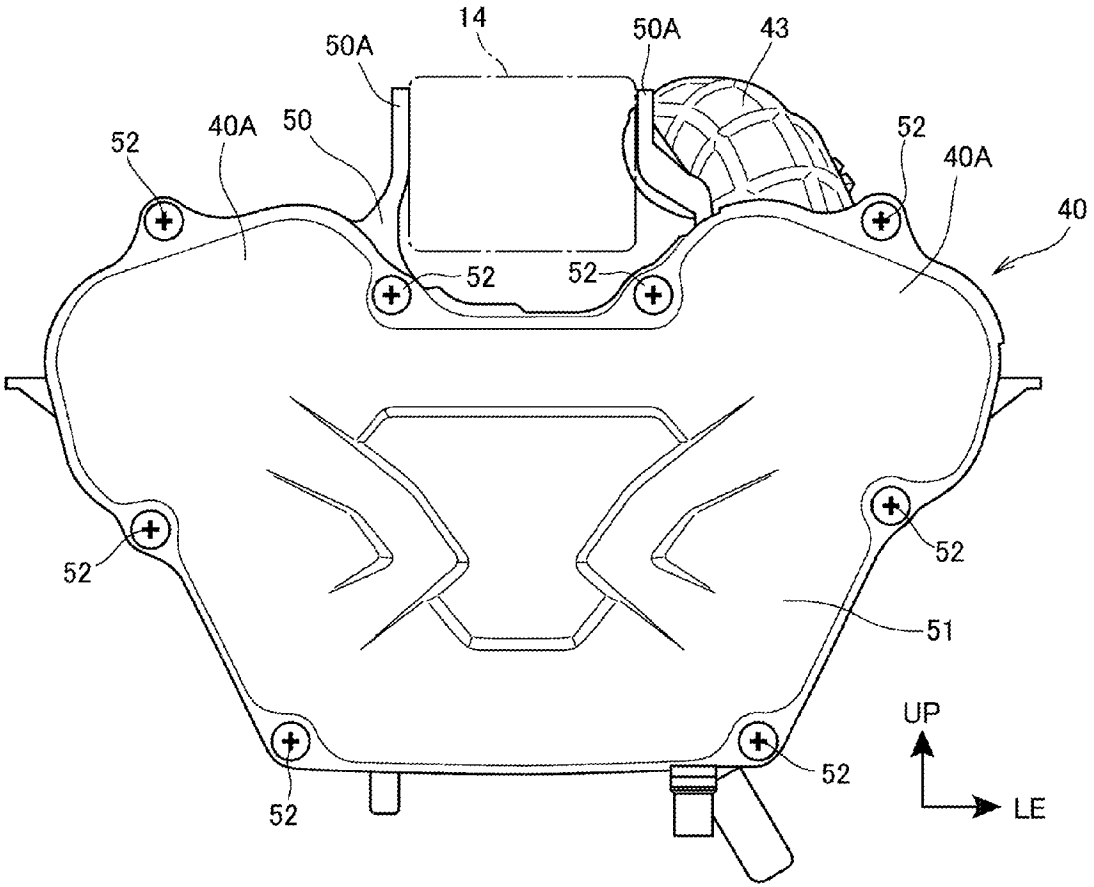
FIG. 4 is a front view of the air cleaner box as seen from front.

FIG. 2 is a right-side view showing the intake device 39 and its vicinity. FIG. 3 is a plan view of the air cleaner box 40 as seen from above. FIG. 4 is a front view of the air cleaner box 40 as seen from front.

As shown in FIGS. 2 to 4, the air cleaner box 40 is formed into a box shape by joining a box-shaped rear case 50 (air cleaner case) open on the front side thereof and a box-shaped front case 51 open on the rear side thereof to each other at their open sides. The rear case 50 is formed deeper than the front case 51 in the front-rear direction. The air cleaner box 40 stretches in the left-right direction with the main frame 14 at the center and is formed longer in the vehicle width direction than in the front-rear direction.

Brackets 50A which project upward and sandwich the main frame 14 from the left and right sides are formed on an upper center portion of the rear case 50 in the vehicle width direction. The rear case 50 is fixed to the main frame 14 with a bolt 47 inserted through each bracket 50A. A stepped portion 50B is formed in a rear lower portion of the rear case 50, the stepped portion 50B being recessed toward the front in such a way as to be separated from the throttle body 41.

In the front view (FIG. 4), the air cleaner box 40 is formed in a substantially trapezoidal shape tapering downward, and bulging portions 40A bulging upward are formed at left and right upper end portions. The main frame 14 passes between the bulging portions 40A.

The front end of the intake duct 43 is connected to an inclined surface 40B provided downwardly rearward on a rear portion of the bulging portion 40A on the left side (one side) of the vehicle body. The intake duct 43 extends rearward while inclining in such a way as to be situated deeper inside in the vehicle width direction toward the rear. The rear end of the intake duct 43 is open toward the rear.

The connecting tube 42 is provided on the opposite side of the main frame 14 from the intake duct 43 and is connected to a rear wall 50C of the rear case 50 in the vicinity of the bulging portion 40A on the right side (the other side) of the vehicle body. Moreover, a temperature sensor 46 which measures the intake air temperature of the air cleaner box 40 is attached to the rear wall 50C on an outer side of the connecting tube 42.

The front case 51 is fixed to the rear case 50 with multiple fixing bolts 52 inserted through a peripheral portion of the front case 51.

Figure 5:
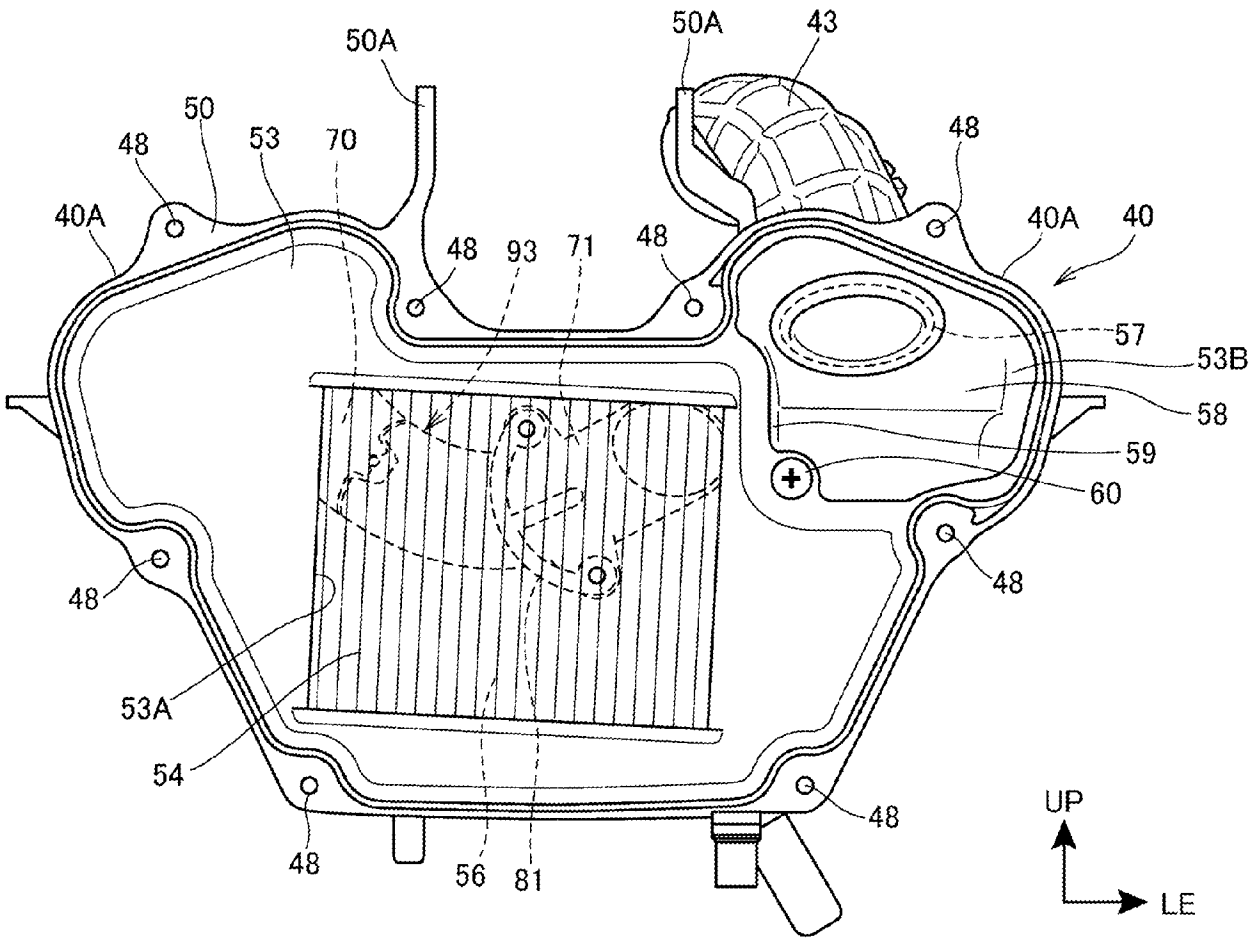
FIG. 5 is a front view of the air cleaner box with a front case detached.

FIG. 5 is a front view of the air cleaner box 40 with the front case 51 detached.

As shown in FIGS. 3 and 5, a plate-shaped element holder 53 is interposed between the contact surfaces of the rear case 50 and the front case 51. The element holder 53 is fitted to a groove portion 50D (FIG. 6) formed along a peripheral portion of the open side of the rear case 50, and is fixed with a bolt 60 disposed inside the air cleaner box 40. Moreover, multiple fixing holes 48 to screw the fixing bolts 52 are formed in the peripheral portion of the open side of the rear case 50.

The element holder 53 has in its center area an element supporting portion 53A formed in the form of a substantially rectangular opening. A plate-shaped filter element 54 which captures dust and the like in air flowing into the air cleaner box 40 is set in the element supporting portion 53A to close the element supporting portion 53A. In this embodiment, the filter element 54 is disposed with its longitudinal direction slightly inclined with respect to the left-right direction of the vehicle.

The inside of the air cleaner box 40 is partitioned in the front-rear direction by the element holder 53 and the filter element 54. In front of the element holder 53 inside the air cleaner box 40, there is formed a pre-purification chamber 55 (FIG. 3) which air that has entered from the intake duct 43 but is yet to be purified by the filter element 54 flows through. Behind the element holder 53, there is formed a post-purification chamber 56 which air having passed through and been purified by the filter element 54 flows through.

The air cleaner box 40 is splittable into two, front and rear parts. By detaching the front case 51, the filter element 54 is exposed, and maintenance of the filter element 54 and the like can therefore be performed easily.

Figure 6:
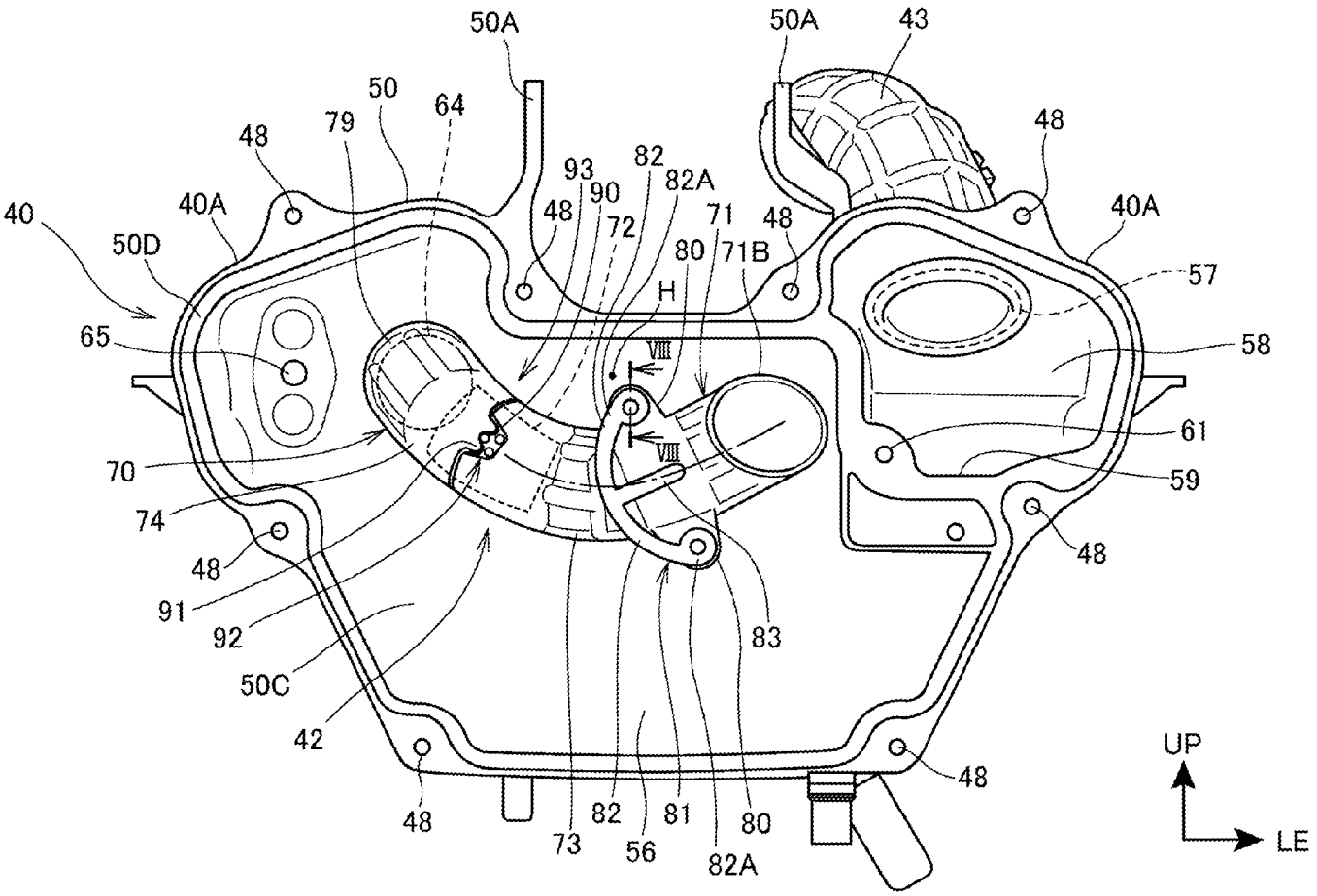
FIG. 6 is a front view of a rear case with an element holder detached.

FIG. 6 is a front view of the rear case 50 with the element holder 53 detached.

As shown in FIG. 6, a duct connecting hole 57 to connect the front end of the intake duct 43 is formed in an upper left end portion of the rear wall 50C of the rear case 50. In the vicinity of the duct connecting hole 57, there is formed a partition wall 59 which is provided in a left upper portion of the inside of the rear case 50 to partition the inside of the rear case 50 into the post-purification chamber 56 and an introducing chamber 58 in the vicinity of the duct connecting hole 57. A fixing hole 61 to screw the bolt 60 is provided in the partition wall 59. Moreover, an opening 53B is formed in the element holder 53 (FIG. 5) at a position corresponding to the introducing chamber 58, so that the introducing chamber 58 communicates with the pre-purification chamber 55 via the opening 53B.

A tube connecting hole 64 to connect the connecting tube 42 is formed in an upper right end portion of the rear wall 50C of the rear case 50. Moreover, a sensor attaching hole 65 to attach the temperature sensor 46 is formed in the rear wall 50C on an outer side of the tube connecting hole 64.

As shown in FIG. 2, the throttle body 41 is connected to the intake port 33A, which is located substantially at the center in the vehicle width direction, through an intake manifold 62 extending upward from the intake port 33A. A front portion of the intake manifold 62 is disposed in the stepped portion 50B of the air cleaner box 40.

The throttle body 41 has a cylindrical portion 63 to which the connecting tube 42 is connected. The cylindrical portion 63 extends from an upper portion of the intake manifold 62 while inclining rearwardly rightward and upward. An upstream end 63A of the cylindrical portion 63 is located behind the air cleaner box 40 to the right of the center in the vehicle width direction and is open rearwardly rightward and upward.

A pulley 63B which drives a throttle valve (not shown) disposed inside the cylindrical portion 63 is provided on the outer side surface of the cylindrical portion 63. A throttle cable (not shown) to be operated by the rider is connected to the pulley 63B.

A fuel supplying hose 34A extending forward from the fuel pump 34 is guided by a stay on the main frame 14 to extend downward and connects to the injector mentioned above.

A breather tube 31A which sends blowby gas to the post-purification chamber 56 extends upwardly forward from the crankcase 31, passes between the connecting tube 42 and the main frame 14, and connects to the rear wall 50C.

Figure 7:
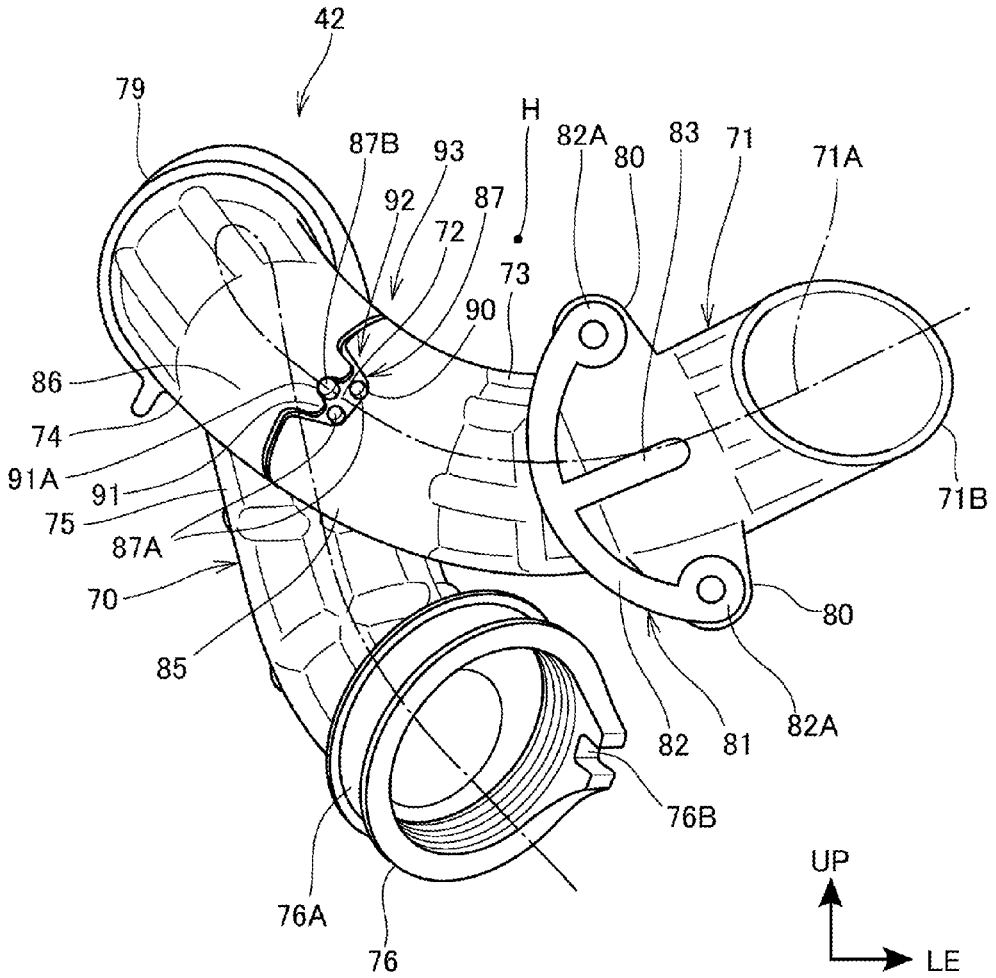
FIG. 7 is a front view of a connecting tube as seen from front.

FIG. 7 is a front view of the connecting tube 42 as seen from front.

As shown in FIGS. 2, 3, 6, and 7, the connecting tube 42 has multiple bent portions so as to increase its tube length within a relatively small space. The connecting tube 42 is longitudinally splittable into two parts so that it can be manufactured easily by blow molding or the like using a mold.

Specifically, the connecting tube 42 includes: a downstream connecting tube 70 extending from the throttle body 41 through the rear wall 50C of the rear case 50 into the post-purification chamber 56; and an upstream connecting tube 71 connected to the downstream connecting tube 70 and extending inside the post-purification chamber 56. The downstream connecting tube 70 and the upstream connecting tube 71 are connected by a middle connecting tube 72 inserted between the downstream connecting tube 70 and the upstream connecting tube 71.

The connecting tube 42 has a first bent portion 73, a second bent portion 74, and a third bent portion 75 in this order from the upstream side. The first bent portion 73 is a part of the upstream connecting tube 71 and extends in the vehicle width direction inside the post-purification chamber 56 while curving in such a way as to bulge downward in the front view (FIGS. 6 and 7). The second bent portion 74 is formed in the downstream connecting tube 70 and bends rearward from the first bent portion 73. The third bent portion 75 extends rearward from the second bent portion 74 through the rear wall 50C, curves downwardly rearward behind the rear wall 50C in the side view (FIG. 2), and connects to the throttle body 41.

An axial line 71A of the upstream connecting tube 71 including the first bent portion 73 extends in the vehicle width direction (the longitudinal direction of the air cleaner box 40) such that it is substantially perpendicular to the front-rear direction of the vehicle in the plan view (FIG. 3). The downstream connecting tube 70 is provided such that an upper part of its axial line 70A is substantially at a right angle to the axial line 71A in the plan view (FIG. 3). Specifically, the axial line 70A is slightly inclined in such a way as to be situated deeper inside in the vehicle width direction toward the rear. In this way, the downstream connecting tube 70 is provided such that its downstream end can near the throttle body 41 at the rear.

Because the connecting tube 42 is formed such that the axial line 71A of the upstream connecting tube 71 and the axial line 70A of the downstream connecting tube 70 extend in different directions, i.e. substantially perpendicular directions as described above, the space is effectively utilized, thereby making it possible to increase the tube length of the connecting tube 42. Accordingly, the low-speed torque of the engine 30 can be increased.

The third bent portion 75 in the downstream connecting tube 70 curves downwardly forward such that its downstream end can be in contact with an opening in the upstream end 63A of the throttle body 41. At this downstream end, a connecting portion 76 is formed which is configured to be fitted on the outer peripheral surface of the upstream end 63A of the cylindrical portion 63. A groove 76A (FIG. 7) in which an annular fixing band 77 is configured to be fitted is formed in the outer peripheral surface of the connecting portion 76. The connecting portion 76 is fixed to the cylindrical portion 63 by fitting the connecting portion 76 onto the cylindrical portion 63 from an upper rear side and fastening the fixing band 77. Moreover, a recessed portion 76B for positioning which engages with a raised portion (not shown) on the cylindrical portion 63 is formed at the tip of the connecting portion 76.

The third bent portion 75 in the downstream connecting tube 70 bend largely in such an arc shape as to bulge rearward in the side view (FIG. 2), and a center axis S of the bend extends in the vehicle width direction. Supporting protrusions 78 which hold a cable or the like are provided on the rear surface of the third bent portion 75.

An upstream portion of the third bent portion 75 penetrates the tube connecting hole 64 in the rear wall 50C at a position coinciding with the main frame 14 in the side view, and enters the post-purification chamber 56. A case connecting portion 79 is formed on the upstream portion of the third bent portion 75 in such a shape as to have a slightly greater diameter in the radial direction. The downstream connecting tube 70 is engaged with an inner peripheral portion of the tube connecting hole 64 through an engagement groove formed in the case connecting portion 79 and is fixed to the rear wall 50C with adhesive provided around the tube connecting hole 64.

The second bent portion 74 bends obliquely downward and inward in the vehicle width direction in the vicinity of the tube connecting hole 64 inside the post-purification chamber 56 and connects to the upstream connecting tube 71.

The upstream connecting tube 71 extends in the vehicle width direction in an upper area inside the post-purification chamber 56 and extends to the vicinity of the partition wall 59. The upstream connecting tube 71 bends largely in the front view (FIG. 6), and a center axis H of the bend (FIGS. 3 and 6) extends in the front-rear direction of the vehicle.

The center axis H of the bend of the upstream connecting tube 71 and the center axis S of the bend of the third bent portion 75 of the downstream connecting tube 70 are oriented in different directions, or in substantially perpendicular directions in particular. In this way, the limited space is effectively utilized, making it possible to increase the tube length of the connecting tube 42. Accordingly, the low-speed torque of the engine 30 can be increased.

At an upstream end 71B of the upstream connecting tube 71, a cut surface is formed in a substantially elliptical shape as if the upstream connecting tube 71 is sliced obliquely. This substantially elliptical cut surface generally faces the filter element 54.

The upstream connecting tube 71 has a pair of attaching portions 80 projecting upward and downward from the outer peripheral surface of the upstream connecting tube 71 in directions substantially perpendicular to the extending direction thereof. The upstream connecting tube 71 is fixed to the inner surface of the rear wall 50C through a holding member 81 that holds the attaching portions 80. When the upstream connecting tube 71 is molded, the attaching portions 80 are molded integrally with the tube body.

The holding member 81 has a length greater than the upstream end 71B of the upstream connecting tube 71 in the front view. The holding member 81 includes: a rod-shaped fixing piece 82 which is provided in such a way as to connect the attaching portions 80 and 80; and a rod-shaped holding piece 83 which holds the outer peripheral surface of the upstream connecting tube 71. The fixing piece 82 is provided in such a way as to curve in a bow shape in the front view and also to curve along the outer peripheral surface of the upstream connecting tube 71, and has, at both ends, holding portions 82A that hold the attaching portions 80. The holding piece 83 extends from a middle portion of the fixing piece 82 in the extending direction of the upstream connecting tube 71 toward the holding portions 82A.

Figure 8:
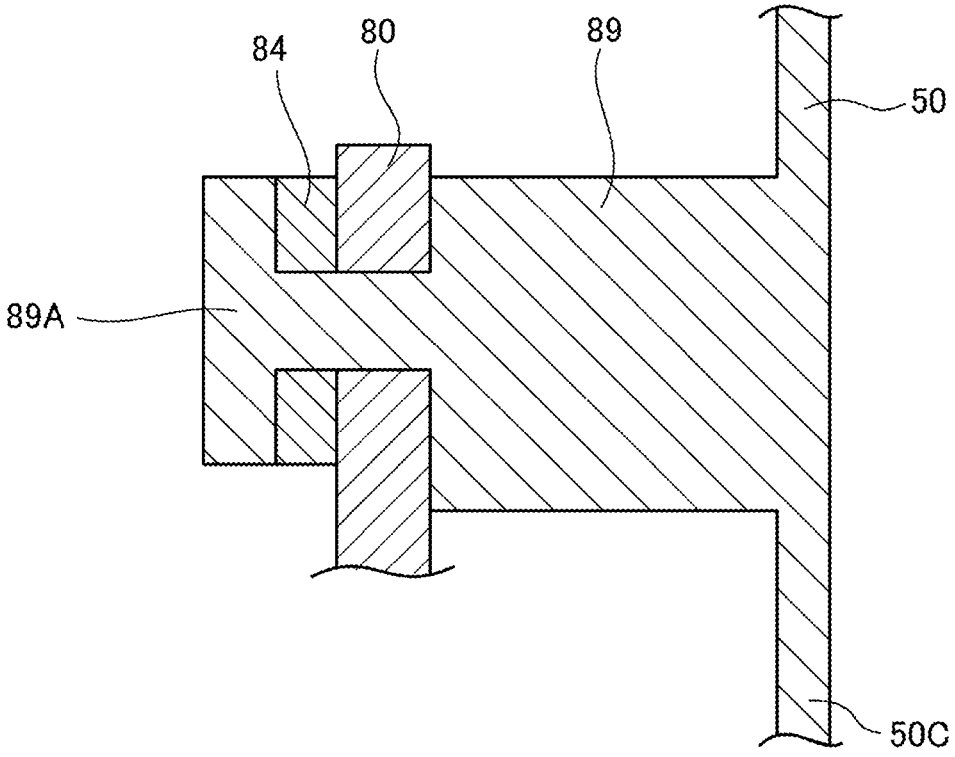
FIG. 8 is a cross-sectional view taken along line VIII-VIII in FIG. 6.

FIG. 8 is a cross-sectional view taken along line VIII-VIII in FIG. 6.

As shown in FIG. 8, on the inner surface of the rear wall 50C, a pair of column portions 89 are formed which project forward toward the attaching portions 80. At the tip of each of the column portions 89, a shaft portion 89A is formed which is configured to be inserted through a hole in the corresponding holding portion 82A of the holding member 81.

The upstream connecting tube 71 is fixed to the column portions 89 by: bringing the attaching portions 80 into contact with the column portions 89 with the shaft portions 89A inserted therethrough; then setting washers 84; and lastly deforming the tip of each shaft portion 89A by thermal caulking into a circular plate shape with a larger diameter than the shaft portion 89A.

As described above, the upstream connecting tube 71 is fixed to the column portions 89 which are provided across both sides of the upstream connecting tube 71, through the holding member 81 of a relatively large size which is provided in such a way as to connect the attaching portions 80. In this way, the outer peripheral surface of the upstream connecting tube 71 can be held through a long area, thereby obtaining high fixing force. Moreover, the holding member 81 is easily handled, thereby allowing easy mounting of the upstream connecting tube 71.

Figure 9:
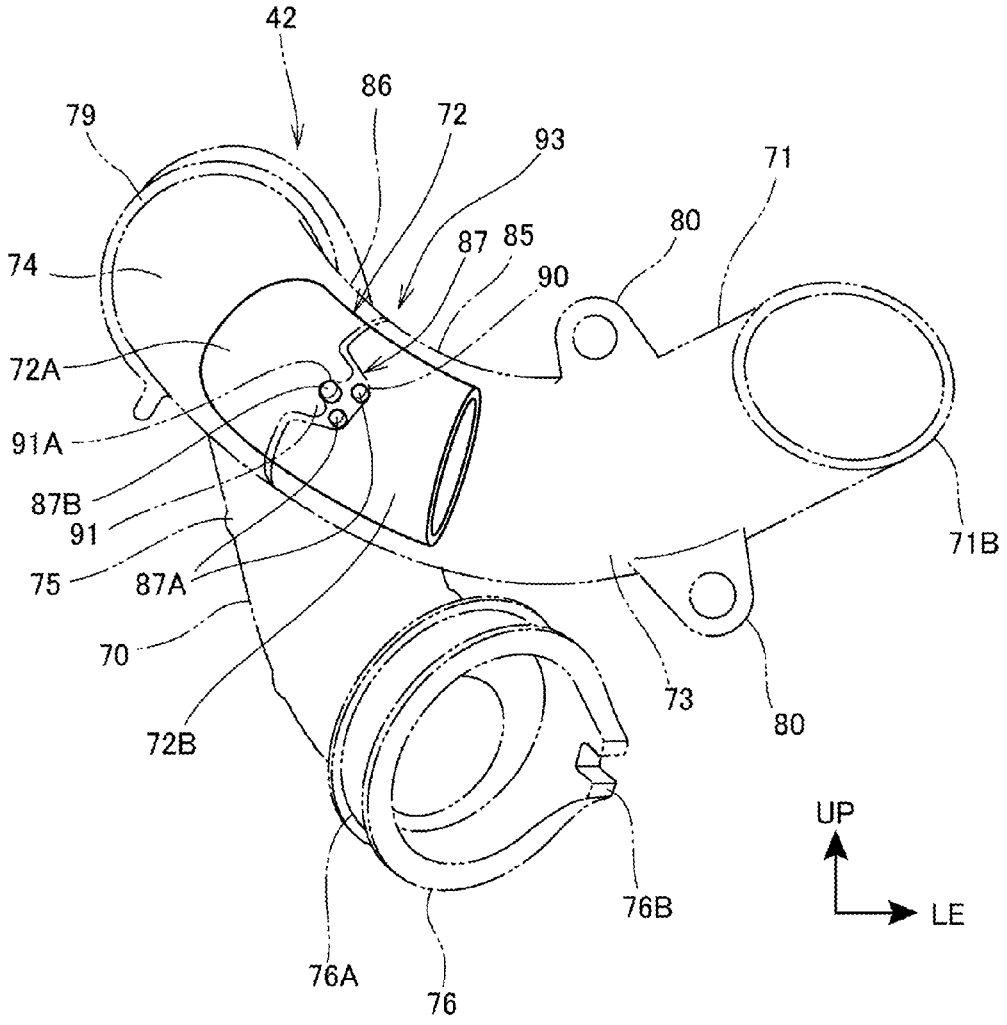
FIG. 9 is a front view showing an attached state of a middle connecting tube.

FIG. 9 is a front view showing an attached state of the middle connecting tube 72. Here, in FIG. 9, the upstream connecting tube 71 and the downstream connecting tube 70 are illustrated with two-dot chain lines.

As shown in FIGS. 7 and 9, the middle connecting tube 72 is inserted and fitted in a radially inner portion of a downstream end portion 85 of the upstream connecting tube 71 and a radially inner portion of an upstream end portion 86 of the downstream connecting tube 70, to thereby connect the upstream connecting tube 71 and the downstream connecting tube 70. The inner diameters of the radially inner portions of the downstream end portion 85 and the upstream end portion 86 are substantially the same. The outer diameter of the middle connecting tube 72 remains substantially the same over the entire length thereof.

In the connected state by the middle connecting tube 72, the end surface of the downstream end portion 85 and the end surface of the upstream end portion 86 are continuous with each other with almost no gap therebetween in the axial direction, and the middle connecting tube 72 is hidden inside the connecting tube 42 except its protruding portion 87 (engagement portion) for positioning.

The protruding portion 87 which engages with the upstream connecting tube 71 and the downstream connecting tube 70 is provided on the outer peripheral surface of an axially middle portion of the middle connecting tube 72. With the protruding portion 87, the middle connecting tube 72 is positioned in the axial direction and in the circumferential direction.

The protruding portion 87 includes: a pair of upstream protrusions 87A provided at substantially the same position in the axial direction of the middle connecting tube 72 and separated from each other in the circumferential direction; and a downstream protrusion 87B provided at a position downstream of the upstream protrusions 87A in the axial direction and between the upstream protrusions 87A in the circumferential direction. The distances from the upstream protrusions 87A to the downstream protrusion 87B are substantially the same. The protruding portion 87 is disposed in such a way that each upstream protrusion 87A and the downstream protrusion 87B form the vertices of a triangle in the front view.

In an outer peripheral portion of the downstream end portion 85 of the upstream connecting tube 71, there is formed a notched portion 90 (engagement portion) of a substantially trapezoidal shape tapering toward the upstream side and being open at the end surface of the downstream end portion 85.

On an outer peripheral portion of the upstream end portion 86 of the downstream connecting tube 70, there is formed a projecting portion 91 which is a part of the wall surface of the upstream end portion 86 projecting in the axial direction in a substantially trapezoidal shape smaller than the shape of the notched portion 90. The projecting portion 91 has a substantially trapezoidal shape tapering toward the tip, and a tip notched portion 91A (engagement portion) open toward the upstream side is formed in a tip portion.

The middle connecting tube 72 is positioned in the circumferential direction and in the axial direction as its downstream portion 72A side is inserted in the upstream end portion 86 and fitted in the downstream connecting tube 70, thus bringing the downstream protrusion 87B into engagement with the tip notched portion 91A of the projecting portion 91. The axial depth to which the middle connecting tube 72 is fitted in the downstream connecting tube 70 is approximately equal to the outer diameter of the middle connecting tube 72.

The middle connecting tube 72 is positioned in the circumferential direction and in the axial direction as its upstream portion 72B side is inserted in the downstream end portion 85 and fitted in the upstream connecting tube 71, thus bringing the upstream protrusion 87A into engagement with a pair of corners at the tip of the notched portion 90. The axial depth to which the middle connecting tube 72 is fitted in the upstream connecting tube 71 is approximately equal to the outer diameter of the middle connecting tube 72. Although the projecting portion 91 enters the notched portion 90, the projecting portion 91 may not be engaged with the notched portion 90 because the projecting portion 91 is positioned by the downstream protrusion 87B.

The protruding portion 87, the projecting portion 91, and the notched portion 90 constitute a positioning part 92 which positions the upstream connecting tube 71, the middle connecting tube 72, and the downstream connecting tube 70 in a predetermined positional relation in the circumferential direction and in the axial direction. Specifically, the positioning part 92 positions the connecting tube 42 to dispose the upstream connecting tube 71 in such a way that the upstream connecting tube 71 extends in the vehicle width direction toward the intake duct 43 while curving in a downwardly bulging shape.

Due to the upstream protrusions 87A and the downstream protrusion 87B, the protruding portion 87 has different shapes on its upstream side and downstream side. Thus, the direction of the middle connecting tube 72 can be easily figured out, and therefore its mountability is good. Moreover, since the positioning part 92 is provided at such a position as to be visually recognizable in the front view, the mountability is good. Furthermore, since the attaching portions 80 are positioned on top of the column portions 89 by positioning the upstream connecting tube 71 with the positioning part 92, the holding member 81 can be mounted easily, and therefore the mountability is good.

As shown in FIG. 6, a joint area 93 at which the upstream connecting tube 71 and the downstream connecting tube 70 are connected by the middle connecting tube 72 is provided inside the post-purification chamber 56. Providing the joint area 93 inside the post-purification chamber 56 which is tightly sealed from outside as described above eliminates the need for firmly connecting the upstream connecting tube 71 and the downstream connecting tube 70 by using a band or the like. Thus, even in the case of the configuration where the tube length is increased by connecting the tubes at the joint area 93, the number of components of the connecting tube 42 can be reduced. Moreover, the positioning part 92 included in the joint area 93 makes it possible to dispose the upstream connecting tube 71 in a predetermined positional relation with a simple configuration.

Furthermore, the downstream connecting tube 70 is introduced to the inside of the post-purification chamber 56 through the tube connecting hole 64 on the right end side of the air cleaner box 40, and the upstream connecting tube 71 is extended across the main frame 14 to the vicinity of the introducing chamber 58 on the left end side. Accordingly, the connecting tube 42 can be lengthened.

The air cleaner box 40 is mounted to the vehicle body through the main frame 14 and the like in the form of a subassembly to which the connecting tube 42 including the upstream connecting tube 71 and the middle connecting tube 72 have been mounted in advance. Here, the connecting tube 42 situated outside the air cleaner box 40 needs only one connecting spot, which is the connecting portion 76 (FIG. 2) for the throttle body 41, and therefore the mounting is easy.

Air entering from the intake duct 43 flows through the introducing chamber 58 to the pre-purification chamber 55, passes through the filter element 54 and flows into the post-purification chamber 56, flows into the connecting tube 42 from the upstream end 71B, flows and curving through the first bent portion 73, the second bent portion 74, and the third bent portion 75, and then reaches the throttle body 41. As described above, by providing the multiple bent portions, the connecting tube 42 can be lengthened, thereby making it possible to improve the low-speed torque of the engine 30.

As described above, the connecting tube 42 connecting the air cleaner box 40 and the throttle body 41 is formed of two or more separate components, i.e. the upstream connecting tube 71 and the downstream connecting tube 70, and the joint area 93 at which these tubes are connected in a predetermined positional relation is disposed inside the air cleaner box 40. Thus, the airtightness of the air cleaner box 40 can be utilized, so that the joint area 93 does not need to be firmly fixed with a component such as a band. Accordingly, it is possible to secure the length of the connecting tube 42 by forming the connecting tube 42, which has multiple bent portions, with the upstream connecting tube 71 and the downstream connecting tube 70 while reducing the number of components.

Moreover, the connecting tube 42 includes the upstream connecting tube 71 disposed inside the air cleaner box 40 and the downstream connecting tube 70 penetrating the air cleaner box 40, and the upstream connecting tube 71 is disposed such that its extending direction is along the longitudinal direction of the post-purification chamber 56 of the air cleaner box 40 in the plan view, whereas the downstream connecting tube 70 is disposed such that its extending direction differs from the extending direction of the upstream connecting tube 71 in the plan view. Accordingly, it is possible to increase the length of the upstream connecting tube 71 inside the post-purification chamber 56 and also to lengthen the connecting tube 42 in accordance with the layout of the engine 30 and the throttle body 41.

Moreover, the upstream connecting tube 71 and the downstream connecting tube 70 are each in a bent form and provided such that the center axis H of the bend of the upstream connecting tube 71 differs from the center axis S of the bend of the downstream connecting tube 70. Accordingly, it is possible to lengthen the upstream connecting tube 71 and the downstream connecting tube 70 in accordance with the layout of the engine 30 and the throttle body 41.

Furthermore, the middle connecting tube 72 which connects the upstream connecting tube 71 and the downstream connecting tube 70 is provided between the upstream connecting tube 71 and the downstream connecting tube 70. Accordingly, it is possible to connect the upstream connecting tube 71 and the downstream connecting tube 70 with a simple configuration.

Moreover, the middle connecting tube 72 is inserted in and connected to the upstream connecting tube 71 and the downstream connecting tube 70, and the protruding portion 87, the notched portion 90, and the tip notched portion 91A are provided to the peripheries of their connected portions as engagement portions for positioning in the circumferential direction. Accordingly, it is possible to position the connecting tube 42 and prevent unnecessary movement of the connecting tube 42 with a simple configuration.

Moreover, on the upstream connecting tube 71, the attaching portions 80 are formed which extend in a direction perpendicular to the extending direction of the upstream connecting tube 71 and are configured to be fixed to the inner side of the rear case 50. Accordingly, it is possible to fix the upstream connecting tube 71 to the inner side of the rear case 50 with a simple configuration.

Furthermore, the two or more attaching portions 80 are provided to the upstream connecting tube 71; and the holding member 81 is provided through which the upstream connecting tube 71 is fixed to the rear case 50 side at the two or more attaching portions 80, and which has such a shape as to connect the fixing spots on the attaching portions 80. The upstream connecting tube 71 can be fixed using the holding member 81 which is relatively large and has an easy-to-handle shape. Accordingly, it is possible to firmly fix the upstream connecting tube 71 and to achieve good workability.

It should be noted that the above embodiment shows one mode to which the present invention is applied, and the present invention is not limited to the above embodiment.

Although the downstream connecting tube 70 and the upstream connecting tube 71 are described as being connected by the middle connecting tube 72 in the above embodiment, the present invention is not limited to this case. It is only necessary to provide the joint area, at which the downstream connecting tube 70 and the upstream connecting tube 71 are connected, within the air cleaner box 40. For example, the middle connecting tube 72 may not be provided. Instead, one of the downstream connecting tube 70 and the upstream connecting tube 71 may be fitted to an inner peripheral portion of the other; engagement portions which engage with each other may be provided to the joint area of the downstream connecting tube 70 and the upstream connecting tube 71; and the engagement portions may be used to connect the downstream connecting tube 70 and the upstream connecting tube 71 in a predetermined positional relation.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. An intake passage structure for a vehicle, comprising:

an air cleaner which purifies air, a throttle body, and a connecting tube to supply purified air to an engine, wherein said connecting tube connects said air cleaner and said throttle body, wherein said connecting tube is formed of two or more separate components, wherein a joint area, at which said two or more separate components of said connecting tube are connected in a predetermined positional relation, is disposed inside said air cleaner, wherein said connecting tube includes an upstream connecting tube disposed inside said air cleaner and a downstream connecting tube penetrating said air cleaner, wherein said upstream connecting tube is disposed such that an extending direction thereof is along a longitudinal direction of a post-purification chamber of said air cleaner, in a plan view, wherein said downstream connecting tube is disposed such that an extending direction thereof differs from the extending direction of said upstream connecting tube, in the plan view, wherein said upstream connecting tube and said downstream connecting tube are each in a bent form, and wherein said upstream connecting tube and said downstream connecting tube are provided such that a center axis of the bend of said upstream connecting tube differs from a center axis of the bend of said downstream connecting tube.

2. The intake passage structure for a vehicle according to claim 1, wherein on said upstream connecting tube, an attaching portion is formed which extends in a direction perpendicular to the extending direction of said upstream connecting tube and is configured to be fixed to an inner side of an air cleaner case.

3. The intake passage structure for a vehicle according to claim 2, wherein two or more of said attaching portions are provided to said upstream connecting tube, and wherein a holding member is provided through which said upstream connecting tube is fixed to said air cleaner case side at said two or more attaching portions, and which has such a shape as to connect positions where each of said at least two attaching portions are respectively fixed to said holding member.

4. An intake passage structure for a vehicle, comprising:

an air cleaner which purifies air, a throttle body, and a connecting tube to supply purified air to an engine, wherein said connecting tube connects said air cleaner and said throttle body, wherein said connecting tube is formed of two or more separate components, wherein a joint area, at which said two or more separate components of said connecting tube are connected in a predetermined positional relation, is disposed inside said air cleaner, wherein said connecting tube includes an upstream connecting tube disposed inside said air cleaner and a downstream connecting tube penetrating said air cleaner, wherein said upstream connecting tube is disposed such that an extending direction thereof is along a longitudinal direction of a post-purification chamber of said air cleaner, in a plan view, wherein said downstream connecting tube is disposed such that an extending direction thereof differs from the extending direction of said upstream connecting tube, in the plan view, wherein a middle connecting tube, which connects said upstream connecting tube and said downstream connecting tube, is provided between said upstream connecting tube and said downstream connecting tube.

5. The intake passage structure for a vehicle according to claim 4, wherein said middle connecting tube is inserted into and connected to said upstream connecting tube and said downstream connecting tube, and wherein engagement portions for positioning in a circumferential direction are provided to peripheries of connected portions of said upstream connecting tube, said downstream connecting tube, and said middle connecting tube.

6. The intake passage structure for a vehicle according to claim 4, wherein on said upstream connecting tube, an attaching portion is formed which extends in a direction perpendicular to the extending direction of said upstream connecting tube and is configured to be fixed to an inner side of an air cleaner case.

7. The intake passage structure for a vehicle according to claim 6, wherein two or more of said attaching portions are provided to said upstream connecting tube, and wherein a holding member is provided through which said upstream connecting tube is fixed to said air cleaner case side at said two or more attaching portions, and which has such a shape as to connect positions where each of said at least two attaching portions are respectively fixed to said holding member.

* * * * *